US007446145B2

(12) United States Patent
Hashimoto et al.

(10) Patent No.: US 7,446,145 B2
(45) Date of Patent: Nov. 4, 2008

(54) WATER AND OIL REPELLENT AQUEOUS COMPOSITION

(75) Inventors: Takafumi Hashimoto, Kyoto (JP); Chiaki Yoshida, Gamo-gun (JP); Masahiro Miyazaki, Kyoto (JP); Kazunori Sugiyama, Yokohama (JP); Syuichiro Sugimoto, Yokohama (JP)

(73) Assignee: Asahi Glass Company, Limited, Tokyo (JP)

( * ) Notice: Subject to any disclaimer, the term of this patent is extended or adjusted under 35 U.S.C. 154(b) by 468 days.

(21) Appl. No.: 11/196,453

(22) Filed: Aug. 4, 2005

(65) Prior Publication Data

US 2006/0005317 A1 Jan. 12, 2006

Related U.S. Application Data

(63) Continuation of application No. PCT/JP2004/001238, filed on Feb. 6, 2004.

(30) Foreign Application Priority Data

Feb. 7, 2003 (JP) ..... 2003-031363

(51) Int. Cl.
*C08K 5/02* (2006.01)
*C08K 5/01* (2006.01)

(52) U.S. Cl. ..... 524/462; 524/487

(58) Field of Classification Search ..... 524/462, 524/487

See application file for complete search history.

(56) References Cited

U.S. PATENT DOCUMENTS

| | | | | |
|---|---|---|---|---|
| 3,533,977 | A | 10/1970 | Read | |
| 4,681,910 | A | 7/1987 | Crockatt et al. | |
| 5,019,428 | A | 5/1991 | Lüdemann et al. | |
| 5,047,065 | A | 9/1991 | Vogel et al. | |
| 5,112,930 | A | 5/1992 | Ludemann et al. | |
| 5,698,356 | A * | 12/1997 | Murata et al. | 430/137.17 |
| 6,624,268 | B1 | 9/2003 | Maekawa et al. | |
| 6,653,376 | B2 | 11/2003 | Sugimoto et al. | |
| 6,716,944 | B2 | 4/2004 | Maekawa et al. | |
| 2004/0087695 | A1 | 5/2004 | Sugimoto et al. | |
| 2006/0005317 | A1 | 8/2005 | Hashimoto et al. | |

FOREIGN PATENT DOCUMENTS

| | | |
|---|---|---|
| GB | 951752 | 3/1964 |
| JP | 1-156581 | 6/1989 |
| JP | 3-290465 | 12/1991 |
| JP | 7-70940 | 3/1995 |
| JP | 7-278468 | 10/1995 |
| JP | 2000-256561 | 9/2000 |

OTHER PUBLICATIONS

"Chinese Chemical Engineering Dictionary", front pages 1-2 pp. 836-837(Translation not available).
U.S. Appl. No. 11/524,918, filed Sep. 22, 2006, Maekawa et al.
U.S. Appl. No. 11/106,641, filed Apr. 15, 2005, Sugimoto et al.
U.S. Appl. No. 12/039,218, filed Feb. 28, 2008, Asada et al.

* cited by examiner

*Primary Examiner*—Robert D. Harlan
(74) *Attorney, Agent, or Firm*—Oblon, Spivak, McClelland, Maier & Neustadt, P.C.

(57) ABSTRACT

To provide a water and oil repellent aqueous composition which is excellent in water and oil repellency, which is less likely to cause an ending phenomenon, which is excellent in stability of a processing bath, which is excellent in storage stability of the composition and which is excellent in foam suppression properties. A water and oil repellent aqueous composition comprising a fluorinated water and oil repellent (A), an emulsified product (B) comprising a paraffin wax (such as a paraffin wax having a melting point of from 50 to 70° C. and a penetration hardness at 25° C. of at most 20) and a carboxyl group-containing polyethylene (such as a carboxyl group-containing polyethylene having a melting point of from 90 to 135° C. and an acid value of from 10 to 30 mgKOH/g), and an organic acid (C).

7 Claims, No Drawings

WATER AND OIL REPELLENT AQUEOUS COMPOSITION

TECHNICAL FIELD

The present invention relates to a water and oil repellent aqueous composition.

BACKGROUND ART

A fluorinated water and oil repellent is excellent in water and oil repellency and is used for water and oil repellent process of fibers. However, the fluorinated water and oil repellent is expensive, and accordingly a water and oil repellent composition comprising a fluorinated water and oil repellent and an extender in combination may be used as a water and oil repellent composition having its cost reduced while maintaining water and oil repellent performance. Further, an extender may be used to develop such characteristics that the color fastness of a dyed cloth will not deteriorate and the texture slippage of a cloth will not occur.

The water and oil repellent composition comprising such an extender in combination may be a composition comprising a paraffin wax, a fatty acid derivative, a silicone compound, a carboxyl group-containing polyethylene, etc. and a fluorinated water and oil repellent (for example, JP-A-1-156581), but it has problems such as insufficient water and oil repellent performance.

Namely, a large quantity of a surfactant is required to emulsify a water and oil repellent composition, thus decreasing the water and oil repellent performance of the resulting composition. Further, the particle size of the emulsified particles of the extender is large, whereby the storage stability of the composition tends to decrease. Further, there are such problems that the stability of a processing bath decreases, and the feeling of a processed fiber product significantly changes.

Further, when an extender is used, an ending phenomenon is increased in general. The ending phenomenon is such a phenomenon that in water and oil repellent process over a long period, the concentration of the water and oil repellent in a processing liquid decreases with time, and the water and oil repellent performance of a treated object will decrease.

DISCLOSURE OF THE INVENTION

The present invention is to solve the above problems of the conventional technology, and it is an object of the present invention to provide a water and oil repellent aqueous composition which is excellent in water and oil repellency, which is less likely to cause an ending phenomenon, which is excellent in stability of a processing bath, which is excellent in the storage stability of the composition and which is excellent in foam suppression properties, available at a low cost.

The present invention provides a water and oil repellent aqueous composition comprising a fluorinated water and oil repellent (A), the following (B) and an organic acid (C):

(B): an emulsified product comprising a paraffin wax and a carboxyl group-containing polyethylene.

BEST MODE FOR CARRYING OUT THE INVENTION

In the present invention, the fluorinated water and oil repellent (A) is not particularly limited so long as it is a compound containing a polyfluoroalkyl group (hereinafter referred to as $R^f$ group). For example, a fluoropolymer to be used as a conventional fluorinated water and oil repellent may be preferably mentioned.

The $R^f$ group is a group having two or more hydrogen atoms in an alkyl group substituted by fluorine atoms. The $R^f$ group has preferably from 1 to 20, particularly preferably from 4 to 16 carbon atoms. The $R^f$ group may have either straight chain structure or branched structure, and when it has a branched structure, the branched moiety is present preferably at the terminal of the $R^f$ group. Part of carbon atoms in the $R^f$ group may be substituted by an etheric oxygen atom or a thioetheric sulfur atom. Further, the $R^f$ group may contain a halogen atom other than fluorine atoms, such as a chlorine atom.

The number of fluorine atoms in the $R^f$ group, as represented by the substitution proportion supposing that hydrogen atoms in an alkyl group having the same number of carbon atoms corresponding to the $R^f$ group are substituted by fluorine atoms, is preferably at 60%, particularly preferably at least 80%. Further, the $R^f$ group is preferably a perfluoroalkyl group which is a group having all hydrogen atoms in an alkyl group substituted by fluorine atoms, and is preferably a group having a perfluoroalkyl group at its terminal.

The fluorinated water and oil repellent (A) in the present invention is preferably a polymer containing $R^f$ groups or a polyurethane compound containing $R^f$ groups, particularly preferably a polymer containing $R^f$ groups.

The polymer containing $R^f$ groups is preferably a polymer comprising polymer units based on an acrylate and/or a methacrylate containing a $R^f$ group. Hereinafter an acrylate and a methacrylate will be generically referred to as (meth)acrylate.

The $R^f$ group-containing (meth)acrylate is preferably a compound represented by the following formula:

$$CH_2{=}C(R)COO\text{-}Q\text{-}R^f \qquad \text{formula 1}$$

wherein R represents a hydrogen atom or a methyl group, Q represents a bivalent organic group, and $R^f$ represents the above $R^f$ group.

Q in the formula 1 is preferably an alkylene group or a bivalent organic group containing an alkylene group, particularly preferably an alkylene group. Especially preferred is $CH_2CH_2$, $CH(CH_3)CH_2$, $CH_2CH_2N(CH_3)CO$, $CH_2CH_2N(CH_3)SO_2$, $CH(CH_2Cl)CH_2OCH_2CH_2N(CH_3)SO_2$ or the like.

$R^f$ in the formula 1 is preferably a perfluoroalkyl group as mentioned above, particularly preferably a perfluoroalkyl group having a straight chain structure represented by $C_nF_{2n+1}$—(wherein n represents an integer of from 4 to 16). Especially preferred is a perfluoroalkyl group having a straight chain structure wherein n is from 6 to 12.

Specific examples of the compound represented by the above formula 1 are shown below. The compound represented by the formula 1 is not limited thereto. In the following compounds, R represents a hydrogen atom or a methyl group, and $R^f$ represents the $R^f$ group:

$CH_2{=}CRCOOCH_2CH_2R^f$,
$CH_2{=}CRCOOCH(CH_3)CH_2R^f$,
$CH_2{=}CRCOOCH_2CH_2N(CH_3)COR^f$,
$CH_2{=}CRCOOCH_2CH_2N(C_2H_5)COR^f$,
$CH_2{=}CRCOOCH_2CH_2N(C_3H_7)COR^f$,
$CH_2{=}CRCOOCH_2CH_2N(CH_3)SO_2R^f$,
$CH_2{=}CRCOOCH_2CH_2N(C_2H_5)SO_2R^f$,
$CH_2{=}CRCOOCH_2CH_2N(C_3H_7)SO_2R^f$,
$CH_2{=}CRCOOCH(CH_2Cl)CH_2OCH_2CH_2N(CH_3)SO_2R^f$.

The $R^f$ group-containing (meth)acrylate may be used alone or two or more types thereof may be used in combination. Further, two or more types of compounds having $R^f$ groups with different number of carbon atoms may be used in combination.

Further, when a polymer comprising polymer units based on the above $R^f$ group-containing (meth)acrylate is used as the fluorinated water and oil repellent (A), it is preferred to incorporate polymer units based on a monomer other than the $R^f$ group-containing (meth)acrylate for the purpose of adjusting the fluorine content in the polymer or for another purpose. Such another polymer is preferably a monomer having a radical polymerizable unsaturated bond.

Such another monomer is preferably vinyl chloride, stearyl (meth)acrylate, ethylene, vinyl acetate, vinyl fluoride, a halogenated vinylstyrene, α-methylstyrene, p-methylstyrene, (meth)acrylic acid, an alkyl (meth)acrylate, a polyoxyalkylene (meth)acrylate, a (meth)acrylamide, a diacetone(meth) acrylamide, an N-methylol (meth)acrylamide, a vinyl alkyl ether, a halogenated alkyl vinyl ether, a vinyl alkyl ketone, butadiene, isoprene, chloroprene, glycidyl (meth)acrylate, aziridinyl (meth)acrylate, benzyl (meth)acrylate, 2-isocyanatoethyl (meth)acrylate, cyclohexyl (meth)acrylate, 2-ethylhexyl (meth)acrylate, maleic anhydride, a (meth)acrylate having polysiloxane, N-vinyl carbazole or the like, more preferably vinyl chloride or stearyl (meth)acrylate.

In the polymer comprising polymer units based on the $R^f$ group-containing (meth)acrylate, the content of the polymer units of the $R^f$ group-containing (meth)acrylate is preferably at least 25 mass %. Sufficient water and oil repellency will be obtained when it is at least 25 mass %.

When the polymer comprising polymer units of the $R^f$ group-containing (meth)acrylate is used as the fluorinated water and oil repellent (A), as a method of producing such a polymer, known or well known polymerization method and conditions are optionally selected. For example, a bulk polymerization method, a suspension polymerization method, an emulsion polymerization method or a solution polymerization method may, for example, be mentioned. Further, a polymerization reaction such as a radical polymerization reaction, a radiation polymerization reaction or a photopolymerization reaction may be mentioned. Particularly preferred is an emulsion polymerization method employing a radical polymerization reaction.

When the emulsion polymerization method is employed, a method of emulsifying and stirring a monomer, a surfactant, etc. in the presence of water for polymerization, may be preferably employed. Otherwise, a method of preliminarily emulsifying a monomer, a surfactant, water, etc. by using an emulsifying machine such as a homogenizer, followed by polymerization with stirring, may also be preferably employed.

As a polymerization initiator, a polymerization initiator such as an organic acid peroxide, an azo compound or a persulfate may be used. Further, as a surfactant, an anionic, cationic, amphoteric or nonionic surfactant may be used.

Further, when an $R^f$ group-containing polyurethane compound is used as the fluorinated water and oil repellent (A), preferred is a reaction product of an $R^f$ compound containing a functional group having reactivity with an isocyanate group with a polyisocyanate compound.

The $R^f$ group containing a functional group having reactivity with an isocyanate group is preferably a compound having a $R^f$ group and a hydoxyl group, a compound having a $R^f$ group and an amino group or a compound having a $R^f$ group and a carboxyl group. Further, the polyisocyanate compound is preferably a polyisocyanate compound having two or more isocyanate groups. Preferred specific examples thereof include tolylene diisocyanate (TDI), diphenylmethane diisocyanate (MDI), naphthalene diisocyanate, hexamethylene diisocyanate, isophorone diisocyanate, xylylene diisocyanate, hydrogenated MDI, lysine diisocyanate, triphenylmethane triisocyanate, and a multimer, an isocyanurate-modified product and a biuret-modified product thereof.

Further, the $R^f$ group-containing polyurethane compound may be a compound obtained by reacting a polyisocyanate compound with a compound containing a functional group having reactivity with an isocyanate group and containing no $R^f$ group, in addition to the $R^f$ compound containing a functional group having reactivity with isocyanate. The compound containing a functional group having reactivity with isocyanate and containing no $R^f$ group may, for example, be an alcohol, an amine or a carboxylic acid. As a preferred $R^f$ group-containing polyurethane compound, compounds as disclosed in JP-A-58-189284 and JP-A-59-157166 may be mentioned.

The fluorinated water and oil repellent (A) in the present invention may be a commercially available one. For example, ASAHI GUARD "AG-7000", "AG-7600", "AG-950", etc. manufactured by Asahi Glass Company, Limited, Unidyne "TG-470", "TG-570", etc. manufactured by DAIKIN INDUSTRIES, LTD. may be mentioned.

The content of the fluorinated water and oil repellent (A) in the water and the oil repellent aqueous composition is preferably from 5 to 40 mass %, more preferably from 10 to 30%, based on the total mass of the composition.

The component (B) in the present invention is an emulsified product comprising a paraffin wax and a carboxyl group-containing polyethylene.

The paraffin wax in the component (B) is a mixture containing a n-paraffin having from 20 to 36 carbon atoms as the main component and containing a small amount of an isoparaffin, a cycloparaffin or an aromatic compound. The n-paraffin is preferably one having a molecular weight of from 300 to 500.

The paraffin wax contains an oil content and a colorant content as impurities. The oil content is preferably at most 0.5% as measured by a method in accordance with JIS K2235. With respect to the colorant component, the brightness, as an index of its content, as measured in accordance with Saybolt color test method in JIS K2580 is preferably at most +28. A higher brightness value means a lower content of the colorant component.

The paraffin wax has a melting point of preferably form 50 to 70° C., particularly preferably 65° C.±3° C. When the melting point is within this range, excellent water and oil repellency will be obtained, and excellent emulsification properties will be obtained.

Further, the paraffin wax has a penetration hardness at 25° C. of preferably at most 20. The penetration hardness is measured in accordance with JIS K2344 and is one of methods for evaluating a paraffin wax. In general, the paraffin wax tends to be soft and the penetration hardness tends to be high, when the content of an isoparaffin in the paraffin wax increases.

The paraffin wax in the present invention may be a commercially available one. For example, "HNP-5" manufactured by NIPPON SEIRO CO., LTD., "145° Paraffin" manufactured by NIPPON OIL CORPORATION, etc. may be mentioned.

The carboxyl group containing polyethylene in the component (B) may, for example, be one obtained by subjecting a polyethylene to air oxidation or thermal decomposition to introduce carboxyl groups thereinto, one obtained by copolymerization of a polyethylene with a vinyl carboxylic acid such as (meth)acrylic acid, or one obtained by grafting a polyethylene with maleic acid.

The carboxyl group-containing polyethylene has a molecular weight of preferably from 1,000 to 5,000. Further, it has a melting point of preferably from 90 to 135° C., more preferably from 95 to 105° C. When the melting point is within this range, excellent emulsification properties will be obtained.

Further, the carboxyl group-containing polyethylene has an acid value of preferably from 10 to 30 mgKOH/g, particularly preferably from 13 to 18 mgKOH/g. The acid value is a numerical value obtained by titrating the carboxyl group-containing polyethylene dissolved in a proper solvent with an alkali such as potassium hydroxide, and is a value as an index of the content of carboxyl groups. When the acid value is within this range, excellent emulsification properties will be obtained.

The carboxyl group-containing polyethylene in the present invention may be a commercially available one. For example, "HIGHWAX 4202E" manufactured by Mitsui Chemicals, Inc., "Licowax PED 521 Granules" manufactured by Clariant, "Luwax OA5" manufactured by BASF, etc. may be mentioned.

In the present invention, the component (B) is an emulsified product. To obtain the emulsified product, the paraffin wax and the carboxyl group-containing polyethylene may be emulsified, respectively, and then they are mixed, but it is preferred to melt and mix the paraffin wax and the carboxyl group-containing polyethylene and then to emulsify the mixture.

For example, a mixture of the paraffin wax and the carboxyl-group containing polyethylene melted by heating (hereinafter referred to as a mixture to be emulsified) is heated together with a proper emulsifier and water with stirring and emulsified. Otherwise, a so-called phase inversion emulsion method may be employed wherein the mixture to be emulsified is melted by heating together with a proper emulsifier, and warm water is dropped thereto, followed by stirring for emulsification.

As the emulsifier to be used for emulsification of the mixture to be emulsified, it is preferred to select one or two or more surfactants within a range not to impair the miscibility of the fluorinated water and oil repellent (A) with the organic acid (C). Further, an emulsification aid may be used together with the surfactant. The emulsification aid is preferably suitably selected depending upon the type of the emulsifier used.

The emulsifier may, for example, be preferably a nonionic surfactant such as a polyoxyalkylene alkyl ether, a cationic surfactant such as a polyoxyalkylene alkylamine or a quaternary ammonium salt, or an anionic surfactant such as an alkylbenzene sulfonate, and is particularly preferably a nonionic surfactant or a cationic surfactant.

As the emulsification aid, in a case where a nonionic surfactant is used as the emulsifier, it is preferred to use an inorganic alkali such as potassium hydroxide, sodium carbonate or sodium bicarbonate, or an organic alkali such as a diethanolamine or a triethanolamine in combination. The emulsification aid functions as a neutrilizer for the carboxylic acids in the carboxyl group-containing polyethylene and increases emulsification properties.

Further, in a case where a cationic surfactant is used as the emulsifier, it is preferred to use as the emulsification aid an inorganic acid such as hydrochloric acid or sulfuric acid or an organic acid such as formic acid or acetic acid in combination. The emulsification aid functions to increase hydrophilicity of the cationic surfactant.

In the component (B), the proportion (mass ratio) of paraffin wax/carboxyl group-containing polyethylene is preferably from 1/1 to 10/1, particularly preferably from 1/1 to 3/1. Within this range, the water and oil repellent aqueous composition will be excellent in water and oil repellent performance, and the composition will be excellent in storage stability.

The emulsified particles of the component (B) have a particle size of preferably at most 200 nm, particularly preferably at most 160 nm. When the particle size is within this range, the component (B) will be excellent in compatibility with the fluorinated water and oil repellent (A), and the resulting product will be excellent in stability.

The water and oil repellent aqueous composition of the present invention has a content of the component (B) of preferably from 1 to 100 parts by mass, more preferably from 25 to 50 parts by mass, per 100 parts by mass of the fluorinated water and oil repellent (A). When the content of the component (B) is within this range, the water and oil repellent aqueous composition will be excellent in water and oil repellent performance and is excellent in storage stability.

Further, the content of the component (B) is preferably from 1 to 10 mass %, more preferably from 3 to 8 mass %, based on the total mass of the water and oil repellent aqueous composition. When the content of the component (B) is within this range, the composition will be excellent in water and oil repellency, will be excellent in foam suppression properties and will be excellent in stability of a processing bath.

In the present invention, it is important that the component (B) is an emulsified product. Namely, it is preferred to use an emulsified product as a molten mixture of a paraffin wax and a carboxyl group-containing polyethylene having high affinity with the paraffin wax and having a hydrophilic group. As the carboxyl group-containing polyethylene is contained, the amount of an emulsifier used to emulsify the mixture to be emulsified can be reduced, whereby the water and oil repellent aqueous composition will be excellent in water and oil repellent performance. Further, the carboxyl group-containing polyethylene functions also as an extender. The emulsified product as the component (B) has a small particle size of emulsion particles thereof and is excellent in compatibility with the fluorinated water and oil repellent, and the resulting composition will be excellent in storage stability. Further, since the water and oil repellent aqueous composition contains the component (B), it is excellent in foam suppression properties of a processing bath.

The organic acid (C) in the present invention, a known one may be used. The organic acid (C) may, for example, be preferably a carboxylic acid, a sulfonic acid or a sulfinic acid, particularly preferably a carboxylic acid.

The carboxylic acid is preferably formic acid, acetic acid, propionic acid, butyric acid, oxalic acid, succinic acid, glutaric acid, adipic acid, malic acid, citric acid or the like, more preferably formic acid or acetic acid. In the present invention, one type of the organic acid (C) may be used, or two or more types thereof may be used in combination. For example, formic acid and acetic acid may be used in combination.

The content of the organic acid (C) is preferably from 0.1 to 10 mass %, more preferably from 1 to 5 mass %, based on the total mass of the water and oil repellent aqueous composition.

As the water and the oil repellent aqueous composition of the present invention contains the organic acid (C), the pH of the processing bath decreases, and the pH is stabilized, whereby the ending phenomenon in water and oil repellent performance can be suppressed. The reason why the ending phenomenon can be suppressed is not necessarily clear, but is considered to be because the zeta potential on the surface of an object to be treated increases due to the decrease in pH of the processing bath, whereby adsorption of the emulsion particles of the fluorinated water and oil repellent is suppressed.

The water and oil repellent aqueous composition of the present invention preferably contains an aqueous medium. The aqueous medium is preferably water or a water-soluble organic solvent, more preferably water.

The water and oil repellent aqueous composition of the present invention is preferably in such a state that the fluorinated water and oil repellent (A) is dispersed in an aqueous medium. As a dispersion method, a method of dispersing the fluorinated water and oil repellent (A) in an aqueous medium using a surfactant by using an emulsifying machine, or a method of obtaining the fluorinated water and oil repellent (A) dispersed in an aqueous medium by an emulsion polymerization, may be mentioned. The surfactant is preferably one which favorably maintains the dispersion state of the fluorinated water and oil repellent (A) and is not particularly limited, and it is preferably a nonionic surfactant or a cationic surfactant.

The water and oil repellent aqueous composition of the present invention may be used together with a chemical to be used for finish processing of fibers. Such a chemical may, for example, be a cross-linking agent such as a melamine resin, a urea-formalin condensate, a glyoxal resin, a blocked isocyanate resin or an epoxy resin, a softening agent such as a dimethyl silicone, an amino-modified silicone, an epoxy-modified silicone or a fatty acid amid or an antistatic agent such as a phosphate compound or a guanidine hydrochloride compound.

The water and oil repellent aqueous composition of the present invention is used preferably for water and oil repellent processing of an object to be treated such as fibers or a fiber product. The water and oil repellent processing method is not particularly limited, and various methods can be employed, so long as a desired amount of the composition is attached to fibers to which the water and oil repellent processing is to be applied. The water and oil repellent processing method may, for example, be a continuous method or a batch method.

As the continuous method, first, the water and oil repellent aqueous composition is diluted with an aqueous medium to prepare a treating liquid. Then, an object to be treated is continuously supplied to an impregnation apparatus filled with the treating liquid to impregnate the object to be treated with the treating liquid, and then unnecessary treating liquid is removed. The impregnation apparatus is not particularly limited, and is preferably a padder impregnation apparatus, a kiss roller impregnation apparatus, a gravure coater impregnation apparatus, a spray impregnation apparatus, a foam impregnation apparatus, a coating impregnation apparatus or the like, particularly preferably a padder impregnation apparatus. Then, an operation of removing water remaining in the object is carried out by using a dryer. The dryer is not particularly limited, and is preferably an expansion dryer such as a tenter or a hot flue. This continuous method is employed preferably in a case where the object to be treated is cloth such as woven cloth.

The batch method comprises a step of immersing the object to be treated with a treating liquid, and a step of removing water remaining in the treated object. The batch method is employed preferably in a case where the object to be treated is not cloth, such as a case where it is bulk fiber, top, sliver, hank, tow or thread, or in a case where it is not suitable for the continuous method such as a case where it is knitted fabric. In the immersion step, it is preferred to use, for example, a cotton dyeing machine, a cheese dying machine, a jet dyeing machine, an industrial washing machine or a beam dyeing machine. In operation of removing water, it is preferred to use a hot air dryer such as a cheese dryer, a beam dryer or a tumble dryer, or a microwave dryer.

The treated object to which the water and oil repellent aqueous composition is attached is preferably subjected to a dry heat treatment. When a dry heat treatment is carried out, active components in the water and oil repellent aqueous composition will more firmly attach to the object to be treated. The temperature for the dry heat treatment is preferably from 120 to 180° C., more preferably from 160 to 180° C. The dry heat treatment time is preferably from 10 seconds to 3 minutes, more preferably from 1 to 2 minutes. The method of the dry heat treatment is not particularly limited, and it is preferred to use a tenter in a case where the object to be treated is cloth.

EXAMPLES

Now, the present invention will be explained in detail with reference to Examples of the present invention (Examples 1 to 3) and Comparative Examples (Examples 4 to 8), but the present invention is not limited to such specific Examples. In Examples, evaluations were carried out in accordance with the following methods. Further, components used in Examples are as described hereinafter.

Method for Evaluating Water and Oil Repellent Performance

Each of water and oil repellent compositions obtained in Examples 1 to 8 was diluted with running water to adjust the active component concentration to 1 mass %, and the resulting liquid was used as a liquid for evaluation.

A dyed polyester cloth was immersed in the above liquid for evaluation and wrung between two rubber rollers so that the wet pickup would be 80 mass %. Then, the cloth was dried at 110° C. for 60 seconds using a pin tenter and subjected to a dry heat treatment at 170° C. for 90 seconds to prepare a cloth for evaluation. Using the obtained cloth for evaluation, water and oil repellency was evaluated.

Water repellency was represented by the water repellency No. shown in Table 1 in accordance with a spray method in JIS L1092 (1998). The oil repellency was judged from the penetration state 30 seconds after several drops (diameter: about 4 mm) of a test solution shown in Table 2 were put on two positions on the cloth for evaluation (AATCC-TM118-1997). "+(−)" with the water repellency No. or the oil repellency No. represents each property being slightly good (poor).

TABLE 1

| Water repellency No. | State |
|---|---|
| 5 | No wetting nor adhesion of water droplets observed on the surface |
| 4 | No wetting observed but adhesion of small water droplets observed on the surface |
| 3 | Wetting by individual small water droplets observed on the surface |
| 2 | Wetting observed on a half area of the surface, and individual small wettings penetrate the cloth |
| 1 | Wetting observed on the entire surface |

TABLE 2

| Oil repellency No. | Test solution | Surface tension mN/m (25° C.) |
|---|---|---|
| 8 | n-heptane | 14.8 |
| 7 | n-octane | 21.4 |
| 6 | n-decane | 23.5 |
| 5 | n-dodecane | 24.7 |
| 4 | n-tetradecane | 26.4 |
| 3 | n-hexadecane | 27.3 |
| 2 | 65 parts of liquid paraffin/ 35 parts of n-hexadecane | 29.6 |
| 1 | Liquid paraffin | 31.5 |
| 0 | Oil repellency inferior to 1 | — |

Ending Properties

Running water was added to each of water and oil repellent compositions obtained in Examples 1 to 8 to adjust the active component concentration to 0.3 mass %, and 30 g of the prepared liquid was used as a liquid for processing treatment.

A dyed nylon cloth was immersed in the above liquid for processing treatment and wrung between two rubber rollers so that the wet pickup would be 35 mass %. A liquid obtained after the wring was totally returned to the remaining liquid for processing treatment. Then, another dyed nylon cloth was immersed in the remaining liquid for processing treatment, and the same operation was carried out repeatedly to obtain ten pieces of treated dyed nylon cloth.

The obtained ten pieces of treated cloth were respectively dried at 110° C. for 60 seconds using a pin tenter and then subjected to a dry heat treatment at 170° C. for 90 seconds. Among these pieces of treated cloth, water repellency was evaluated with respect to tenth treated cloth and regarded as evaluation of ending properties.

Processing Bath Stability

Running water was added to each of water and oil repellent compositions obtained in Examples 1 to 8 to adjust the active component concentration to 0.4 mass %, and 250 g of the prepared liquid was put in a 300 mL glass beaker and kept at 30° C. to obtain a processing sample liquid.

The processing sample liquid was stirred at 2,500 rpm for 5 minutes using a homogenizer. The processing sample liquid after stirred was subjected to filtration using as a filter cloth a black polyester dyed cloth. A residue after filtration was visually judged based on standards shown in Table 3 and regarded as evaluation of processing bath stability.

TABLE 3

| Evaluation | Standards |
|---|---|
| 5 | No residue present at all |
| 4 | A very small amount of residue present |
| 3 | Residue dotted over the filter cloth |
| 2 | Residue present on the entire surface of the filter cloth |
| 1 | Thick residue present on the entire surface of the filter cloth |

Storage Stability

Each of water and oil repellent compositions obtained in Examples 1 to 8 was left to stand in a thermostatic chamber at 40° C., and the change in appearance was visually judged based on standards shown in Table 4 and regarded as evaluation of storage stability.

TABLE 4

| Evaluation | Standards |
|---|---|
| 5 | No separation nor precipitation observed even after six months or longer after preparation |
| 4 | Separation or precipitation observed at a time from three months to six months after preparation |
| 3 | Separation or precipitation observed at a time from two weeks to three months after preparation |
| 2 | Separation or precipitation observed at a time from two days to two weeks after preparation |
| 1 | Separation or precipitation observed a day after preparation |

Foam Suppression Properties

Running water was added to each of water and oil repellent compositions obtained in Examples 1 to 8 to adjust the active component concentration to 4 mass %, and 400 mL of the prepared liquid was put in a 1,000 mL glass beaker and kept at 30° C. to obtain a sample liquid.

The sample liquid was circulated using a magnet pump (MD-15, manufactured by IWAKI & CO., LTD.) under conditions at a pump discharge amount of 430 mL/min, at a discharge nozzle inner diameter of 1 mm and at a height of a discharge nozzle from the liquid face of 10 cm, and the amount of foam generated after a lapse of 15 minutes was visually judged based on standards shown in Table 5, and regarded as evaluation of foam suppression properties. A higher value indicates excellent foam suppression properties.

TABLE 5

| Evaluation | Standards |
|---|---|
| 5 | All generated foam immediately disappears |
| 4 | A very small amount of generated foam present on liquid surface |
| 3 | The height of generated foam is lower than the top surface of the beaker |
| 2 | The height of generated foam is higher than the top surface of the beaker |
| 1 | Generated foam spills from the beaker |

Component A

ASAHI GUARD AG-7000 (manufactured by Asahi Glass Company, Limited, active component concentration: 20%) was used as it was.

Component B1

170 g of a paraffin wax "HNP-5" (manufactured by NIPPON SEIRO CO., LTD., melting point: 62° C., penetration hardness at 25° C.: 4), 100 g of a carboxyl group-containing polyethylene "LICOWAX PED 522" (manufactured by Clariant, melting point: 103 to 105° C., acid value: 15 to 19), 30 g of a nonionic surfactant "Emulgen 210P" (manufactured by Kao Corporation), 700 g of deionized water and 5 g of triethanolamine were put in a pressure resistant emulsification kettle and sealed. These materials were heated to 110 to 120° C. with stirring and emulsified at from 110 to 120° C. for about 30 minutes under elevated pressure. The obtained emulsified product was a white liquid.

Component B2

170 g of "HNP-5", 100 g of "LICOWAX PED 522", 30 g of "Emulgen 210P" and 5 g of triethanolamine were put in a pressure resistant emulsification kettle and heated to 110 to 120° C. with stirring at a low speed, whereby these materials were melted and uniformly mixed. 370 g of deionized water at from 85 to 95° C. was gradually dropped over a period of about 30 minutes with stirring at from 110 to 12° C. After completion of the dropping, the mixture was left to cool to 60° C. with stirring, and then 330 g of deionized water was added. The obtained emulsified product was a white liquid.

Component B3

270 g of "HNP-5", 90 g of "Emulgen 210P" and 700 g of deionized water were put in a pressure resistant emulsification kettle and sealed, heated to 110 to 120° C. with stirring and then emulsified at from 110 to 120° C. for about 30 minutes under elevated pressure. The obtained emulsified product was a white liquid.

Component B4

270 g of "HNP-5", 30 g of "Emulgen 210P" and 700 g of deionized water were put in a pressure resistant emulsification kettle and sealed, heated to 110 to 120° C. with stirring and then emulsified at from 110 to 120° C. for about 30 minutes under elevated pressure. The obtained emulsified product was a white liquid.

Component B5

130 g of "HNP-5", 140 g of "LICOWAX PED 522", 30 g of "Emulgen 210P", 700 g of deionized water and 7 g of triethanolamine were put in a pressure resistant emulsification kettle and sealed, heated to 110 to 120° C. with stirring and then emulsified at from 110 to 120° C. for about 30 minutes under elevated pressure. The obtained emulsified product was a white liquid.

Component B6

210 g of "HNP-5", 60 g of "LICOWAX PED 522", 30 g of "Emulgen 210P", 700 g of deionized water and 3 g of triethanolamine were put in a pressure resistant emulsification kettle and sealed, heated to 110 to 120° C. with stirring and then emulsified at from 110 to 120° C. for about 30 minutes under elevated pressure. The obtained emulsified product was a white liquid.

Component C

Industrial acetic acid (manufactured by SHOWA DENKO K.K.) was used as it was.

Example 1

70 parts by mass of component A, 20 parts by mass of component B1, 1 part by mass of component C and 9 parts by mass of deionized water were mixed to obtain a water and oil repellent composition. Performances were evaluated with respect to the obtained water and oil repellent composition. The results are shown in Table 7.

Examples 2 to 8

Component A, component B and component C were mixed in a composition as shown in Table 6 in an amount (unit: part(s) by mass) as shown in Table 6 to obtain a water and oil repellent composition. With respect to the obtained water and oil repellent composition, performances were evaluated in the same manner as in Example 1. The results are shown in Table 7.

TABLE 6

| Component | A | B1 | B2 | B3 | B4 | B5 | B6 | C | Water |
|---|---|---|---|---|---|---|---|---|---|
| Ex. 1 | 70 | 21 | — | — | | — | — | 1 | 9 |
| Ex. 2 | 55 | 35 | — | — | | — | — | 1 | 9 |
| EX. 3 | 70 | — | 20 | — | | — | — | 1 | 9 |
| EX. 4 | 70 | — | — | 20 | | — | — | 1 | 9 |
| EX. 5 | 70 | — | — | — | 20 | — | — | 1 | 9 |
| EX. 6 | 70 | — | — | — | — | 20 | — | 1 | 9 |
| EX. 7 | 70 | — | — | — | — | — | 20 | 1 | 9 |
| EX. 8 | 70 | 20 | — | — | — | — | — | — | 10 |

TABLE 7

| | Water repel-lency | Oil repel-lency | Ending properties | Processing bath stability | Product stability | Foam suppression properties |
|---|---|---|---|---|---|---|
| Ex. 1 | 5 | 5 | 5 | 5 | 5 | 5 |
| Ex. 2 | 5 | 4+ | 5 | 5 | 5 | 5 |
| EX. 3 | 5 | 5 | 5 | 5 | 5 | 5 |
| EX. 4 | 4 | 3+ | 5 | 3 | 2 | 3 |
| EX. 5 | 5 | 4+ | 5 | 3 | 2 | 5 |
| EX. 6 | 4 | 3− | 4 | 3 | 5 | 5 |
| EX. 7 | 3 | 3− | 4 | 4 | 4 | 4 |
| EX. 8 | 5 | 5 | 2 | 5 | 5 | 5 |

INDUSTRIAL APPLICABILITY

The water and oil repellent aqueous composition of the present invention is excellent in water and oil repellency, is less likely to cause an ending phenomenon, is excellent in stability of a processing bath, is excellent in stability of the composition and is excellent in foam suppression properties. Further, a fiber product processed by means of the water and oil repellent aqueous composition of the present invention is excellent in water and oil repellent performance, and is therefore suitable for clothes and the like.

The entire disclosure of Japanese Patent Application No. 2003-31363 filed on Feb. 7, 2003 including specification, claims and summary is incorporated herein by reference in its entirety.

What is claimed is:

1. A water and oil repellent aqueous composition comprising a fluorinated compound having water and oil repellent properties (A), the following (B) and an organic acid (C):

(B): an emulsified product comprising a paraffin wax and a carboxyl group-containing polyethylene.

2. The water and oil repellent aqueous composition according to claim 1, wherein the paraffin wax in the above (B) has a melting point of from 50 to 70° C. and a penetration hardness at 25° C. of at most 20.

3. The water and oil repellent aqueous composition according to claim 1, wherein the carboxyl group-containing polyethylene in the above (B) has a melting point of from 90 to 135° C. and an acid value of from 10 to 30 mgKOH/g.

4. The water and oil repellent aqueous composition according to claim 1, wherein the content of the above (B) is from 1 to 100 parts by mass per 100 parts by mass of the above fluorinated compound having water and oil repellent properties (A).

5. The water and oil repellent aqueous composition according to claim 1, wherein the content of the above organic acid (C) is from 0.1 to 10 mass% based on the total mass of the water and oil repellent aqueous composition.

6. The water and oil repellent aqueous composition according to claim 1, wherein the above fluorinated compound having water and oil repellent properties (A) is a polymer comprising polymer units based on $CH_2{=}C(R)COO{-}Q{-}R^f$ (wherein R represents a hydrogen atom or a methyl group, Q represents a bivalent organic group, and $R^f$ represents a polyfluoroalkyl group).

7. A fiber product processed by the water and oil repellent aqueous composition as defined in claim 1.

* * * * *